US008322402B2

(12) United States Patent
Blejde et al.

(10) Patent No.: US 8,322,402 B2
(45) Date of Patent: Dec. 4, 2012

(54) METHOD AND APPARATUS FOR CONTROLLING STRIP TEMPERATURE REBOUND IN CAST STRIP

(75) Inventors: Walter N. Blejde, Brownsburg, IN (US); Rama Ballav Mahapatra, Brighton-Le Sands (AU); Mark Schlichting, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 171 days.

(21) Appl. No.: 12/885,988

(22) Filed: Sep. 20, 2010

(65) Prior Publication Data

US 2011/0067835 A1 Mar. 24, 2011

Related U.S. Application Data

(60) Provisional application No. 61/245,093, filed on Sep. 23, 2009.

(51) Int. Cl.
*B22D 11/06* (2006.01)
*B22D 11/16* (2006.01)

(52) U.S. Cl. ..... 164/480; 164/428; 164/425; 164/151.4; 164/154.7

(58) Field of Classification Search ..... 164/428, 164/480, 452, 151.4, 450.3, 154.7, 155.3, 164/155.4, 155.6
See application file for complete search history.

(56) References Cited

U.S. PATENT DOCUMENTS

| | | | | |
|---|---|---|---|---|
| 5,031,688 | A * | 7/1991 | Burgo et al. | 164/452 |
| 6,568,459 | B2 | 5/2003 | Ashburn | |
| 8,002,016 | B2 * | 8/2011 | Rees et al. | 164/480 |

FOREIGN PATENT DOCUMENTS

| | | | |
|---|---|---|---|
| CN | 1887479 | | 1/2007 |
| CN | 1887479 | A * | 1/2007 |
| JP | 55-075869 | | 6/1980 |
| JP | 58-142207 | | 8/1983 |
| JP | 01-309759 | | 12/1989 |
| JP | 03-060852 | | 3/1991 |
| JP | 2009-119486 | | 6/2009 |
| KR | 1020000040610 | | 7/2000 |

* cited by examiner

*Primary Examiner* — Kevin P Kerns
(74) *Attorney, Agent, or Firm* — Hahn, Loeser & Parks LLP; Arland T. Stein

(57) ABSTRACT

During continuously casting metal strip, delivering molten metal supported on the casting surfaces of the casting rolls, and counter rotating the casting rolls to form metal shells on the casting surfaces brought together at the nip to deliver cast strip downwardly with a controlled amount of mushy material between the metal shells, determining at a reference location downstream from the nip a target temperature for the cast strip corresponding to a desired amount of mushy material between the metal shells of the cast strip, sensing the temperature of the cast strip cast downstream from the nip at the reference location and producing a sensor signal corresponding to the sensed temperature, and causing an actuator to vary the gap at the nip between the casting rolls in response to the sensor signal received from the sensor and processed to determine the temperature difference between the sensed temperature and the target temperature.

27 Claims, 11 Drawing Sheets
(1 of 11 Drawing Sheet(s) Filed in Color)

METHOD AND APPARATUS FOR CONTROLLING STRIP TEMPERATURE REBOUND IN CAST STRIP

This application claims priority to and the benefit of U.S. Provisional Patent Application 61/245,093, filed Sep. 23, 2009, the disclosure of which is incorporated herein by reference.

BACKGROUND AND SUMMARY

This invention relates to the casting of metal strip by continuous casting in a twin roll caster.

In a twin roll caster molten metal is introduced between a pair of counter-rotated horizontal casting rolls that are cooled so that metal shells solidify on the moving roll surfaces and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

The twin roll caster may be capable of continuously producing cast strip from molten steel through a sequence of ladles. Pouring the molten metal from the ladle into smaller vessels before flowing through the metal delivery nozzle enables the exchange of an empty ladle with a full ladle without disrupting the production of cast strip.

During casting, the casting rolls rotate such that metal from the casting pool solidifies into shells on the casting rolls that are brought together at the nip to produce a cast strip downwardly from the nip. One of the difficulties in the past has been high frequency chatter, which should be avoided because of surface defects caused in the strip. Temperature increase as the cast strip leaves the nip, called temperature rebound, is also a concern, and can cause enlargement of the shell due to ferrostatic pressure from the casting pool resulting in ridges in the strip. Temperature rebound occurs when the center of the strip contains "mushy" material, i.e. the metal between the shells that have not solidified to be self supporting, and the latent heat from the center material will cause the shells to reheat after leaving the casting rolls.

We have found that the defects caused by high frequency chatter and temperature rebound can be controlled by maintaining and controlling the amount of mushy material that is "swallowed" in the cast strip and subsequently cooled. Some mushy material sandwiched between the solidified shells is provided to cushion the unevenness in the growth and cooling of the shells and inhibits if not eliminates high frequency chatter and the attendant strip defects. At the same time, the amount of mushy metal between the solidified shells is controlled to reduce and control the amount of temperature rebound in the cast strip. If the rebound temperature is not controlled, it can cause at least partial remelting of the solidified shells and defects in the strip such as ridges, and in severe circumstances, breakage of the strip where the temperature is too high and more excessive remelting of the shells occur. The mushy material may include molten metal and partially solidified metal, and includes all the material between the shells not sufficiently solidified to be self supporting.

To further explain, immediately below the nip the mushy material in the strip is in communication with the casting pool due to the ferrostatic pressure. When an excess amount of mushy metal is between the shells of the strip below the nip, a high temperature rebound begins to re-melt and weaken the solidified shells of the cast strip. Weakened shells may locally bulge due to the ferrostatic pressure causing local excessive strip budge, surface defects in the cast strip, and severe weakening may cause strip breakage. Also, when an excess amount of mushy material is between the shells near the strip edges, the mushy material may enlarge the edges of the strip causing "edge bulge," or may drip from the edges of the cast strip causing "edge loss."

We have found desired properties by maintaining a consistent austenitic microstructure in the cast strip at the hot rolling mill downstream of the caster. The increased temperature from temperature rebound may re-heat the strip to a temperature forming δ-ferrite, which upon cooling returns to a coarser and more variable austenite microstructure.

We presently disclose a method where temperature rebound and its attendant strip defects can be controlled while inhibiting high frequency chatter. Disclosed is a method of continuously casting metal strip including

- assembling a pair of counter-rotatable casting rolls having casting surfaces laterally positioned to form a gap at a nip between the casting rolls through which thin cast strip can be cast,
- assembling a metal delivery system adapted to deliver molten metal above the nip to form a casting pool supported on the casting surfaces of the casting rolls and confined at the ends of the casting rolls and counter rotating the casting rolls to form metal shells on the casting surfaces of the casting rolls that are brought together at the nip to deliver cast strip downwardly with a controlled amount of mushy material between the metal shells,
- determining at a reference location downstream from the nip a target temperature for the cast strip corresponding to a desired amount of mushy material between the metal shells of the cast strip,
- sensing the temperature of the cast strip cast downstream from the nip at the reference location and producing a sensor signal corresponding to the sensed temperature, and
- causing an actuator to vary the gap at the nip between the casting rolls in response to the sensor signal received from the sensor and processed to determine the temperature difference between the sensed temperature and the target temperature.

The gap between the casting rolls may be varied by the actuator to control the amount of mushy material between the metal shells of the strip cast to be between about 10 and 200 micrometers in response to the processed sensor signal. Alternatively, the amount of mushy material between the metal shells of the strip cast may be between about 10 and 100 micrometers in response to the processed sensor signal. In yet another alternative, the amount of mushy material between the metal shells of the strip cast may be between about 20 and 50 micrometers in response to the processed sensor signal.

The casting rolls may be counter-rotated to provide a casting speed between about 40 and 100 meters per minute, and the as-cast thickness of the cast strip may be between about 0.6 and 2.4 millimeters.

The casting pool height may be between about 125 and 250 millimeters above the nip. The heat flux density through the casting rolls may be between about 7 and 15 megawatts per square meter of casting roll surface.

An apparatus for continuously casting metal strip may include a pair of counter-rotatable casting rolls having casting surfaces laterally positioned to form a gap at a nip between the casting rolls through which thin cast strip can be cast, a metal delivery system adapted to deliver molten metal above the nip to form a casting pool supported on the casting surfaces of the casting rolls and confined at the ends of the casting rolls that are brought together at the nip to deliver cast strip downwardly from the nip with a controlled amount of mushy material between the metal shells, a sensor adapted to sensing the temperature of the cast strip downstream from the nip at a reference location and producing a sensor signal corresponding to the temperature of the cast strip below the nip, and a controller adapted to control an actuator to vary the gap between the casting rolls to provide a controlled amount of mushy material between the metal shells of the cast strip at the nip in response to the sensor signal received from the sensor and processed to determine the temperature difference between the sensed temperature and a target temperature.

Again, the gap between the casting rolls may be varied by the actuator to control the amount of mushy material between the metal shells of the strip cast to be between about 10 and 200 micrometers in response to the processed sensor signal. Alternatively, the amount of mushy material between the metal shells of the strip cast may be between about 10 and 100 micrometers in response to the processed sensor signal. In yet another alternative, the amount of mushy material between the metal shells of the strip cast may be between about 20 and 50 micrometers in response to the processed sensor signal.

Again, the casting rolls may be counter-rotated to provide a casting speed between about 40 and 100 meters per minute, and the as-cast thickness of the cast strip may be between about 0.6 and 2.4 millimeters.

Again, the casting pool height may be between about 125 and 250 millimeters above the nip. The heat flux density through the casting rolls may be between about 7 and 15 megawatts per square meter of casting roll surface.

One or more sensors are provided adapted to sensing the location of the casting rolls and producing a sensor signal corresponding to the position of the casting rolls. Alternatively or in addition, one or more sensors may be provided adapted to sensing a force exerted on the cast strip adjacent the nip and producing a sensor signal corresponding to the force exerted on the cast strip adjacent the nip.

Also disclosed is a method of continuously casting metal strip including the steps of:

assembling a pair of counter-rotatable casting rolls having casting surfaces laterally positioned to form a gap at a nip between the casting rolls through which thin cast strip can be cast, assembling a metal delivery system adapted to deliver molten metal above the nip to form a casting pool supported on the casting surfaces of the casting rolls and confined at the ends of the casting rolls and counter rotating the casting rolls to form metal shells on the casting surfaces of the casting rolls that are brought together at the nip to deliver cast strip downwardly with a controlled amount of mushy material between the metal shells, determining at a reference location downstream a target temperature for the cast strip from the nip corresponding to a desired amount of mushy material between the metal shells of the cast strip to produce a desired strip crown, sensing the temperature of the cast strip cast downstream from the nip at the reference location and producing a sensor signal corresponding to the sensed temperature, and causing an actuator to vary the gap at the nip between the casting rolls in response to the sensor signal received from the sensor and processed to determine the temperature difference between the sensed temperature and the target temperature to produce the desired strip crown.

The step of determining a target temperature may include the steps of receiving a customer-specified strip crown, and determining the target temperature to produce the customer-specified strip crown.

BRIEF DESCRIPTION OF THE DRAWINGS

The patent or application file contains at least one drawing executed in color. Copies of this patent with color drawing(s) will be provided by the Patent and Trademark Office upon request and payment of necessary fee.

DETAILED DESCRIPTION OF THE DRAWINGS

Referring now to FIGS. 1 through 7, a twin roll caster is illustrated that comprises a main machine frame 10 that stands up from the factory floor and supports a pair of casting rolls mounted in a module in a roll cassette 11. The casting rolls 12 are mounted in the roll cassette 11 for ease of operation and movement as described below. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls as described herein.

Figure 3:
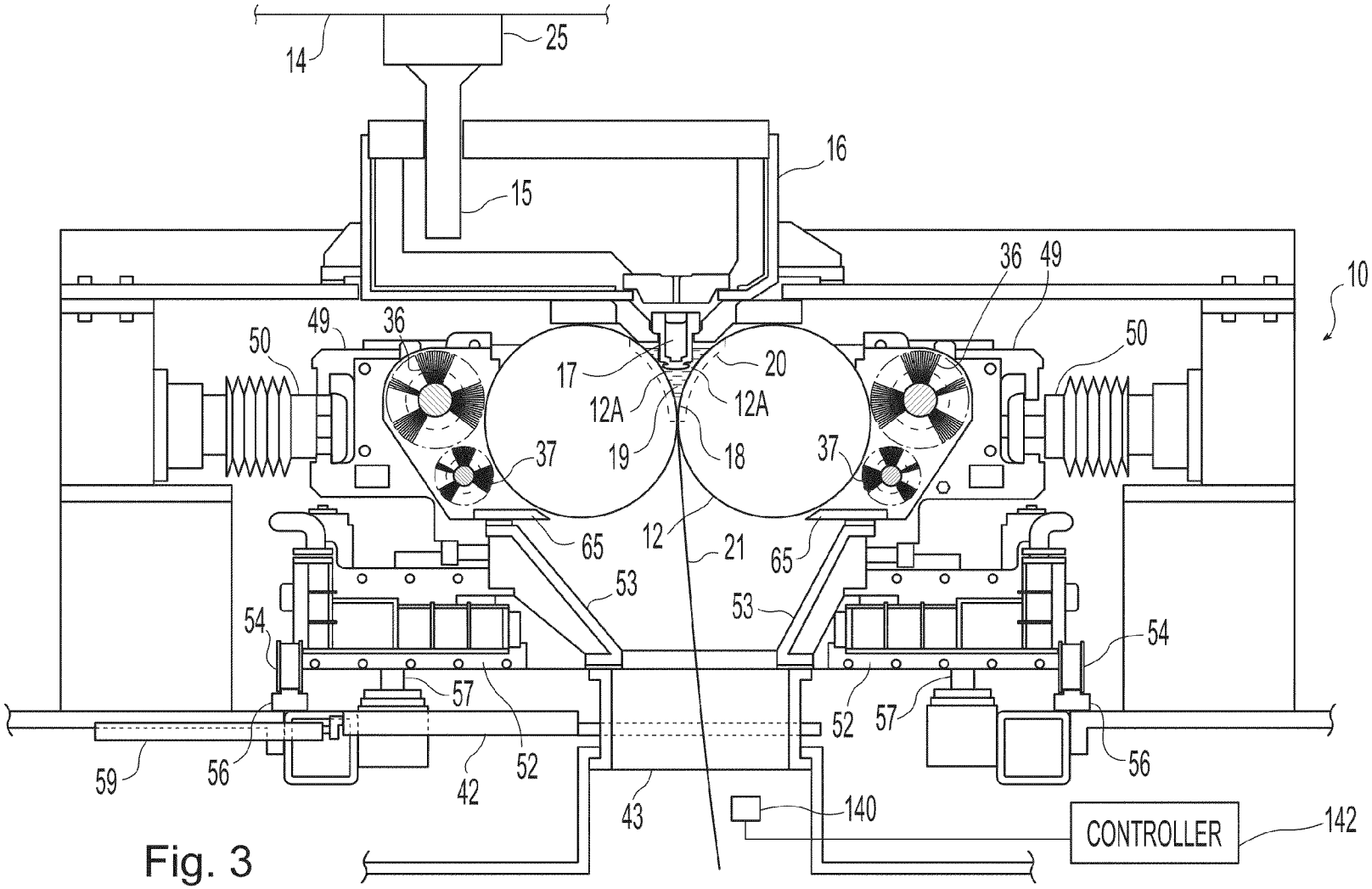
FIG. 3 is a partial sectional view through a pair of casting rolls mounted in a roll cassette of the present disclosure.

As shown in FIG. 3, the casting apparatus for continuously casting thin steel strip includes a pair of counter-rotatable casting rolls 12 having casting surfaces 12A laterally positioned to form a nip 18 there between. Molten metal is supplied from a ladle 13 through a metal delivery system to a metal delivery nozzle 17, or core nozzle, positioned between the casting rolls 12 above the nip 18. Molten metal thus delivered forms a casting pool 19 of molten metal above the nip supported on the casting surfaces 12A of the casting rolls 12. This casting pool 19 is confined in the casting area at the ends of the casting rolls 12 by a pair of side closures or side dam plates 20 (shown in dotted line in FIG. 3). The upper surface of the casting pool 19 (generally referred to as the "meniscus" level) may rise above the lower end of the delivery nozzle 17 so that the lower end of the delivery nozzle is immersed within the casting pool. The casting area includes the addition of a protective atmosphere above the casting pool 19 to inhibit oxidation of the molten metal in the casting area.

The delivery nozzle 17 is made of a refractory material such as alumina graphite. The delivery nozzle 17 may have a series of flow passages adapted to produce a suitably low velocity discharge of molten metal along the rolls and to deliver the molten metal into the casting pool 19 without direct impingement on the roll surfaces. The side dam plates 20 are made of a strong refractory material and shaped to engage the ends of the rolls to form end closures for the molten pool of metal. The side dam plates 20 may be moveable by actuation of hydraulic cylinders or other actuators (not shown) to bring the side dams into engagement with the ends of the casting rolls.

Figure 1:
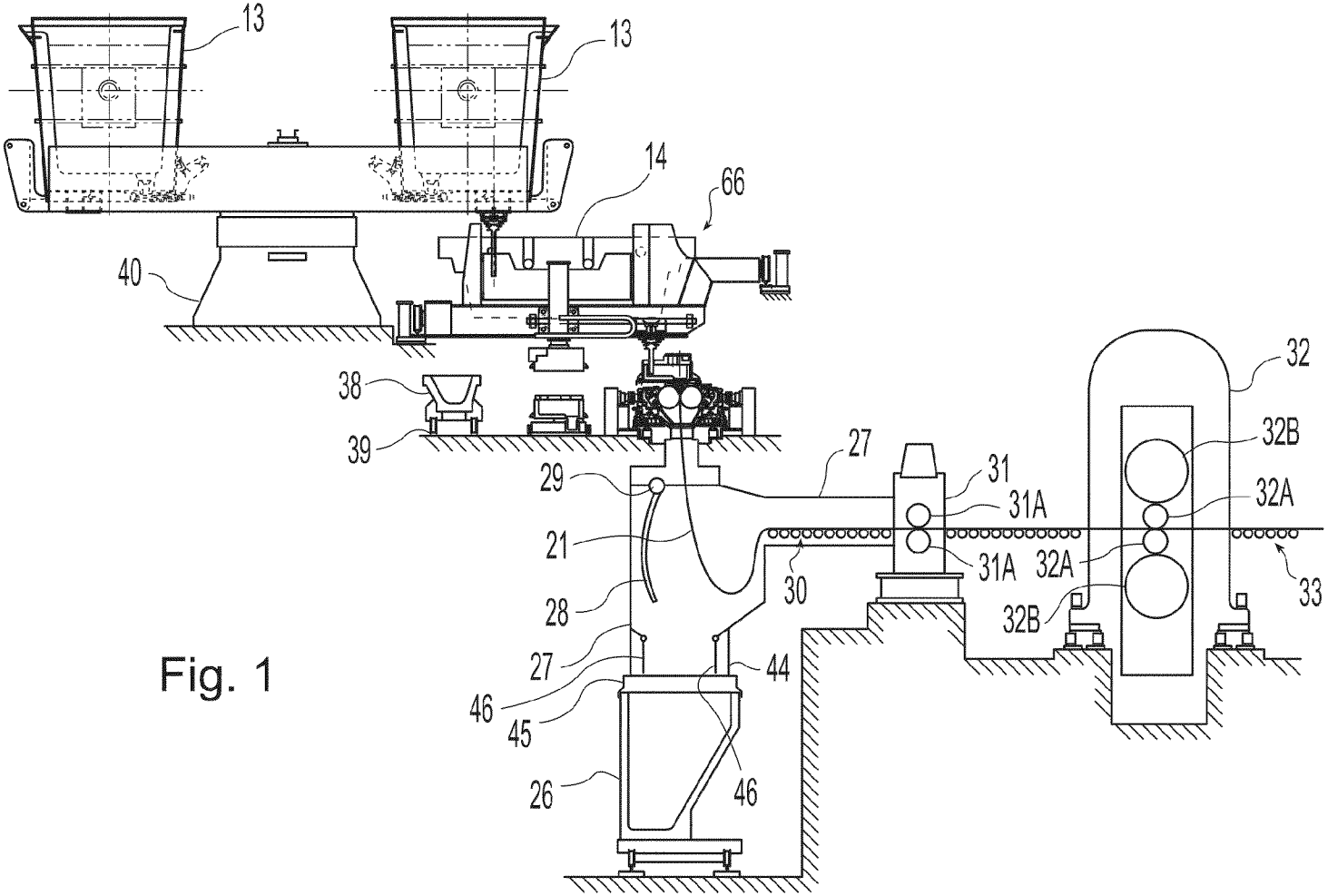
FIG. 1 is a diagrammatical side view of a twin roll caster of the present disclosure.
Figure 2:
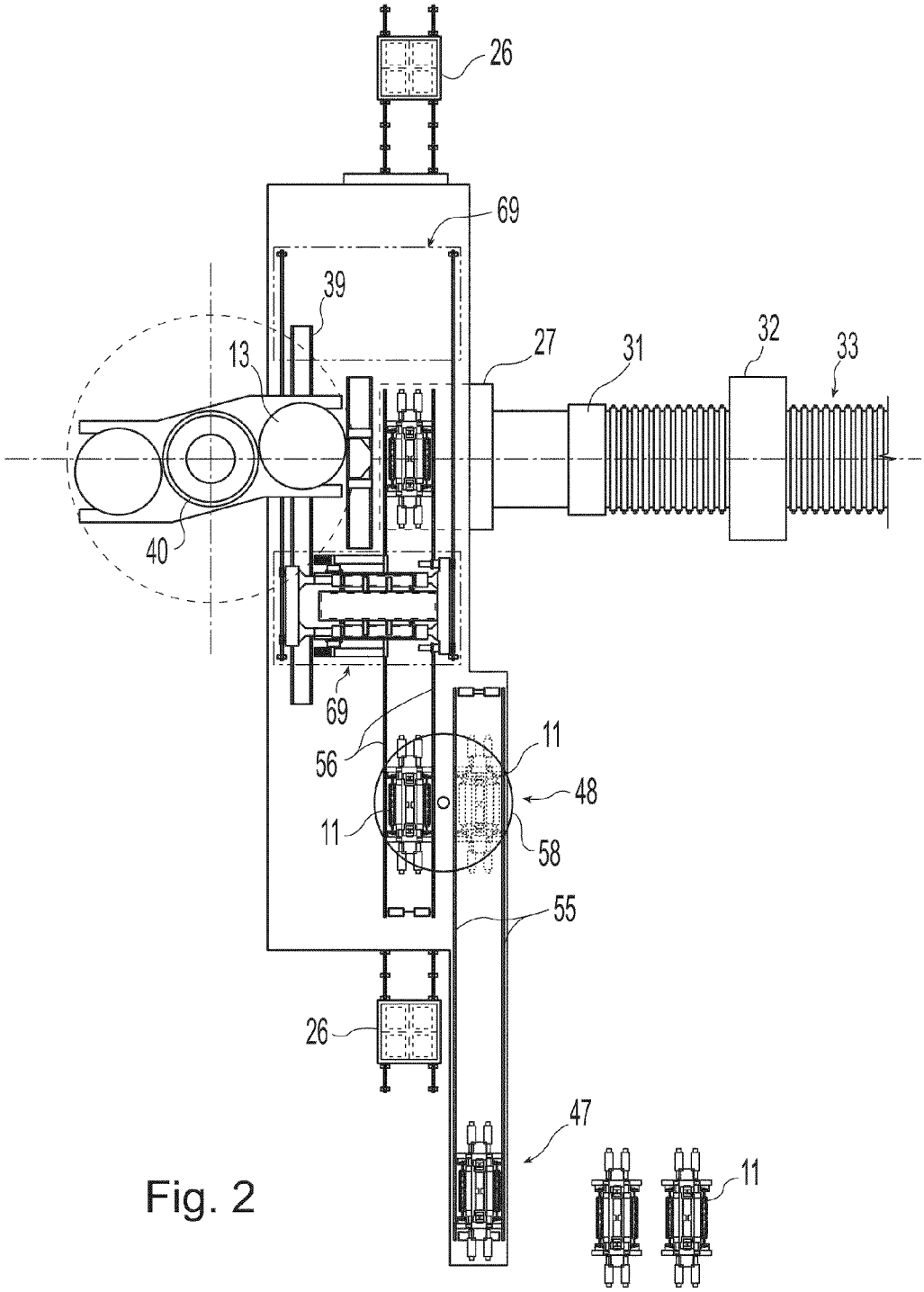
FIG. 2 is a diagrammatical plan view of the twin roll caster of FIG. 1.

Referring now to FIGS. 1 and 2, the ladle 13 typically is of a conventional construction supported on a rotating turret 40. For metal delivery, the ladle 13 is positioned over a movable tundish 14 in the casting position to fill the tundish with molten metal. The movable tundish 14 may be positioned on a tundish car 66 capable of transferring the tundish from a heating station 69, where the tundish is heated to near a casting temperature, to the casting position. A tundish guide positioned beneath the tundish car 66 to enable moving the movable tundish 14 from the heating station 69 to the casting position.

The tundish car 66 may include a frame adapted to raising and lowering the tundish 14 on the tundish car 66. The tundish car 66 may move between the casting position to a heating station at an elevation above the casting rolls 12 mounted in roll cassette 11, and at least a portion of the tundish guide may be overhead from the elevation of the casting rolls 12 mounted on roll cassette 11 for movement of the tundish between the heating station and the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. The distributor 16 is made of a refractory material such as, for example, magnesium oxide (MgO). From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces move into contact with and through the casting pool 19 with each revolution of the casting rolls 12. The shells are brought together at the nip 18 between the casting rolls to produce a solidified thin cast strip product 21 delivered downwardly from the nip. FIG. 1 shows the twin roll caster producing the thin cast strip 21, which passes across a guide table 30 to a pinch roll stand 31, comprising pinch rolls 31A. Upon exiting the pinch roll stand 31, the thin cast strip may pass through a hot rolling mill 32, comprising a pair of reduction rolls 32A and backing rolls 32B, where the cast strip is hot rolled to reduce the strip to a desired thickness, improve the strip surface, and improve the strip flatness. The rolled strip then passes onto a run-out table 33, where it may be cooled by contact with water supplied via water jets or other suitable means, not shown, and by convection and radiation. In any event, the rolled strip may then pass through a second pinch roll stand (not shown) to provide tension of the strip, and then to a coiler.

At the start of the casting operation, a short length of imperfect strip is typically produced as casting conditions stabilize. After continuous casting is established, the casting rolls are moved apart slightly and then brought together again to cause this leading end of the strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls in enclosure 27 before it passes to the guide table 30 where it engages a succession of guide rollers.

An overflow container 38 may be provided beneath the movable tundish 14 to receive molten material that may spill from the tundish. As shown in FIGS. 1 and 2, the overflow container 38 may be movable on rails 39 or another guide such that the overflow container 38 may be placed beneath the movable tundish 14 as desired in casting locations. Additionally, an overflow container may be provided for the distributor 16 adjacent the distributor (not shown).

The sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal", "sealed", "sealing", and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 is in selective engagement with the upper edges of the scrap receptacle 26, which is illustratively in a rectangular form, so that the scrap receptacle may be in sealing engagement with the enclosure 27 and movable away from or otherwise disengageable from the scrap receptacle as desired.

Figure 4:
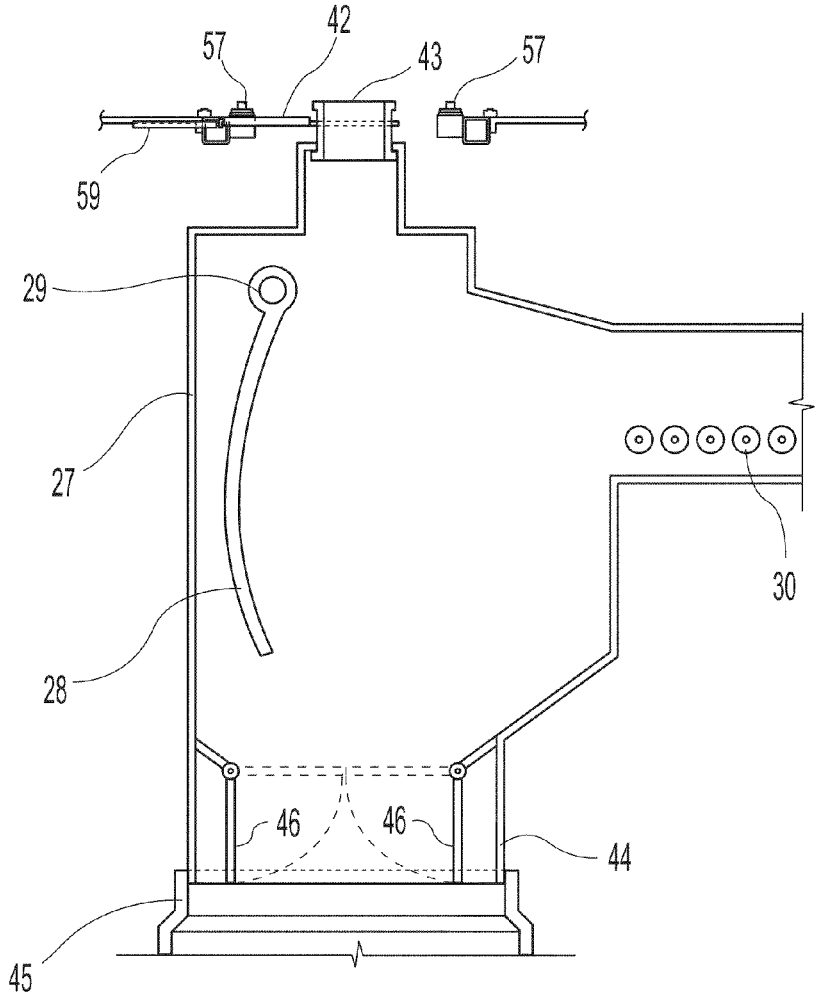
FIG. 4 is a diagrammatical side view of the enclosure of the caster beneath the casting rolls.

A lower plate 46 may be operatively positioned within or adjacent the lower enclosure portion 44 to permit further control of the atmosphere within the enclosure when the scrap receptacle 26 is moved from the scrap receiving position and provide an opportunity to continue casting while the scrap receptacle is being changed for another. The lower plate 46 may be operatively positioned within the enclosure 27 adapted to closing the opening of the lower portion of the enclosure, or lower enclosure portion 44, when the rim portion 45 is disengaged from the scrap receptacle. Then, the lower plate 46 may be retracted when the rim portion 45 sealingly engages the scrap receptacle to enable scrap material to pass downwardly through the enclosure 27 into the scrap receptacle 26. The lower plate 46 may be in two plate portions as shown in FIGS. 1 and 4, pivotably mounted to move between a retracted position and a closed position, or may be one plate portion as desired. A plurality of actuators (not shown) such as servo-mechanisms, hydraulic mechanisms, pneumatic mechanisms and rotating actuators may be suitably positioned outside of the enclosure 27 adapted to moving the lower plate in whatever configuration between a closed position and a retracted position. When sealed, the enclosure 27 and scrap receptacle 26 are filled with a desired gas, such as nitrogen, to reduce the amount of oxygen in the enclosure and provide a protective atmosphere for the cast strip.

The enclosure 27 may include an upper collar portion 43 supporting a protective atmosphere immediately beneath the casting rolls in the casting position. The upper collar portion 43 may be moved between an extended position adapted to supporting the protective atmosphere immediately beneath the casting rolls and an open position enabling an upper cover 42 to cover the upper portion of the enclosure 27. When the roll cassette 11 is in the casting position, the upper collar portion 43 is moved to the extended position closing the space between a housing portion 53 adjacent the casting rolls 12, as shown in FIG. 3, and the enclosure 27 by one or a plurality of actuators (not shown) such as servo-mechanisms, hydraulic mechanisms, pneumatic mechanisms, and rotating actuators. The upper collar portion 43 may be water cooled.

The upper cover 42 may be operably positioned within or adjacent the upper portion of the enclosure 27 capable of moving between a closed position covering the enclosure and a retracted position enabling cast strip to be cast downwardly from the nip into the enclosure 27 by one or more actuators 59, such as servo-mechanisms, hydraulic mechanisms, pneumatic mechanisms, and rotating actuators. When the upper cover 42 is in the closed position, the roll cassette 11 may be moved from the casting position without significant loss of the protective atmosphere in the enclosure. This enables a rapid exchange of casting rolls, with the roll cassette, since closing the upper cover 42 enables the protective atmosphere in the enclosure to be preserved so that it does not have to be replaced.

The casting rolls 12 mounted in roll cassette 11 are capable of being transferred from a set up station 47 to a casting position through a transfer station 48, as shown in FIG. 2. The casting rolls 12 may be assembled into the roll cassette 11 and then moved to the set up station 47, where at the set up station the casting rolls mounted in the roll cassette may be prepared for casting. At the transfer station 48, casting rolls mounted in roll cassettes may be exchanged, and in the casting position the casting rolls mounted in the roll cassette are operational in the caster. A casting roll guide is adapted to enable the transfer of the casting rolls mounted in the roll cassette between the set up station and the transfer station, and between the transfer station and the casting position. The casting roll guides may comprise rails on which the casting rolls 12 mounted in the roll cassette 11 are capable of being moved between the set up station and the casting position through the transfer station. Rails 55 may extend between the set up station 47 to the transfer station 48, and rails 56 may extend between the transfer station 48 to the casting position. The casting rolls mounted in a roll cassette may be raised or lowered into the casting position.

In one embodiment, the roll cassette 11 may include wheels 54 capable of supporting and moving the roll cassette on the rails 55, 56.

As shown in FIG. 2, the transfer station 48 may include a turntable 58. The rails 55, 56 may be capable of being aligned with rails on the turntable 58 of the transfer station such that the turntable 58 may be turned to exchange casting rolls mounted in roll cassettes between the first rails 55 and the second rails 56. The turntable 58 may rotate about a center axis to transfer a roll cassette from one set of rails to another.

The roll cassette 11 with casting rolls may be assembled in a module for rapid installation in the caster in preparation for casting strip, and for rapid set up of the casting rolls 12 for installation. The roll cassette 11 comprises a cassette frame 52, roll chocks 49 capable of supporting the casting rolls 12 and moving the casting rolls on the cassette frame, and the housing portion 53 positioned beneath the casting rolls capable of supporting a protective atmosphere in the enclosure 27 immediately beneath the casting rolls during casting. The cassette frame 52 may include linear bearings and/or other guides adapted to assist movement of the casting rolls toward and away from one another. The housing portion 53 is positioned corresponding to and sealingly engaging an upper portion of the enclosure 27 for enclosing the cast strip below the nip.

Figure 9:
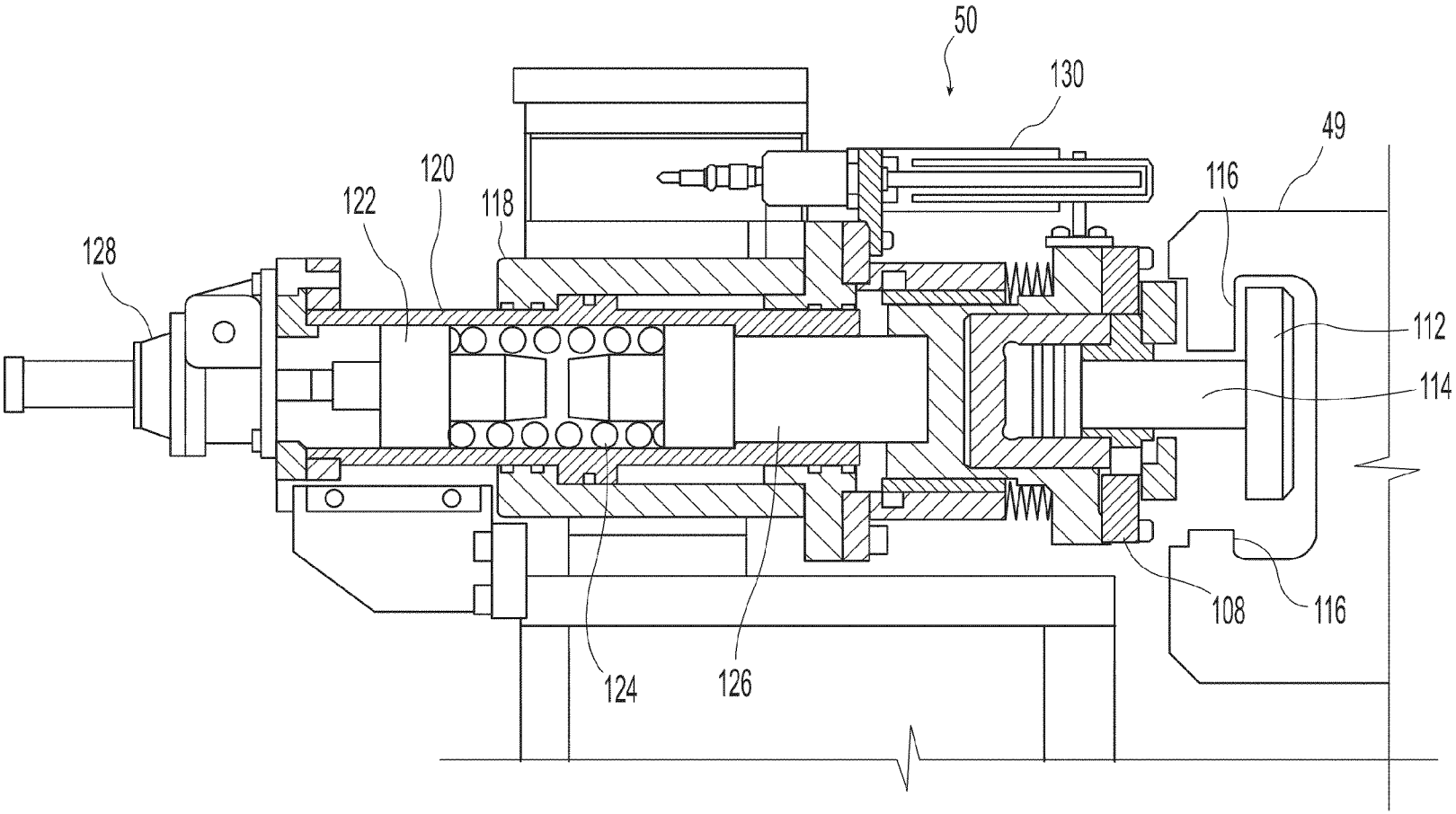
FIG. 9 is a sectional view through a positioning assembly in the retracted position of FIG. 7.

A roll chock positioning system is provided on the main machine frame 10 having two pairs of positioning assemblies 50 that can be rapidly connected to the roll cassette adapted to enable movement of the casting rolls on the cassette frame 52, and provide forces resisting separation of the casting rolls during casting. The positioning assemblies 50 may include a compression spring provided to control one of the casting rolls. As shown in FIG. 9, the positioning assembly 50 has a flange 112 capable of engaging the roll cassette 11. The positioning assembly 50 may be secured to the roll cassette by a flange cylinder 114. The flange cylinder 114 is engaged to secure the flange 112 against a corresponding surface 116 of the roll cassette 11. Alternatively, the positioning assemblies 50 may include actuators such as mechanical roll biasing units or servo-mechanisms, hydraulic or pneumatic cylinders or mechanisms, linear actuators, rotating actuators, magnetostrictive actuators or other devices for enabling movement of the casting rolls and resisting separation of the casting rolls during casting. In one alternative, the positioning assemblies 50 may include positioning actuators such as disclosed in U.S. Pat. No. 8,002,016 issued Aug. 23, 2011.

Figure 8:
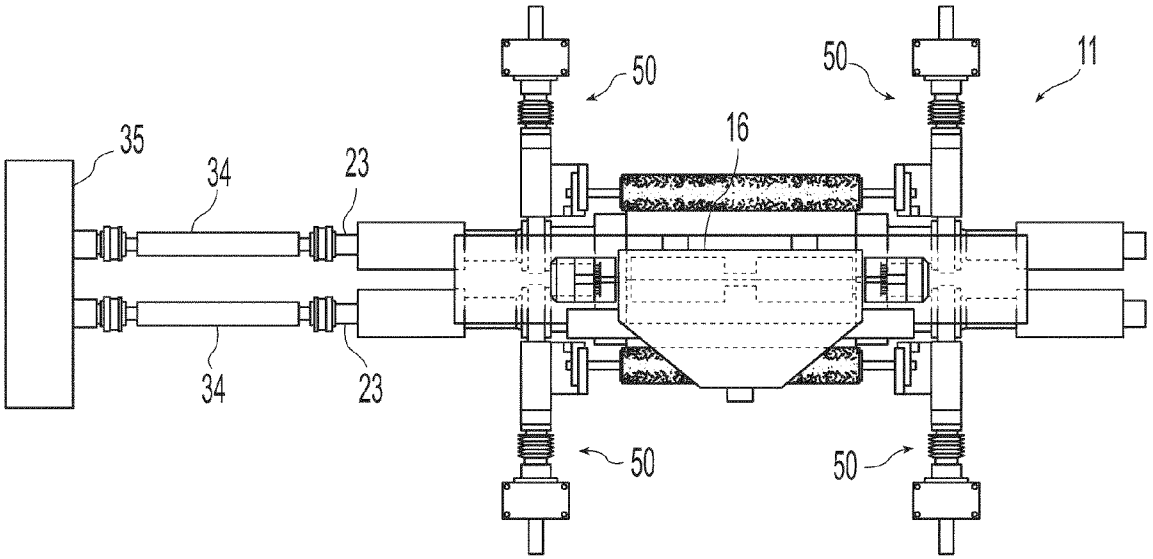
FIG. 8 is a diagrammatical plan view of casting rolls mounted in a roll cassette in a casting position.

The casting rolls 12 include shaft portions 22, which are connected to drive shafts 34, best viewed in FIG. 8, through end couplings 23. The casting rolls 12 are counter-rotated through the drive shafts by an electric motor (not shown) and transmission 35 mounted on the main machine frame. The drive shafts can be disconnected from the end couplings 23 when the cassette is to be removed enabling the casting rolls to be changed without dismantling the actuators of the positioning assemblies 50. The casting rolls 12 have copper peripheral walls formed with an internal series of longitudinally extending and circumferentially spaced water cooling passages, supplied with cooling water through the roll ends from water supply ducts in the shaft portions 22, which are connected to water supply hoses 24 through rotary joints (not shown). The casting rolls 12 may be about 500 millimeters in diameter, or may be up to 1200 millimeters or more in diameter. The length of the casting rolls 12 may be up to about 2000 millimeters, or longer, in order to enable production of strip product of about 2000 millimeters width, or wider, as desired in order to produce strip product approximately the width of the rolls. Additionally, the casting surfaces may be textured with a distribution of discrete projections, for example, random discrete projections as described and claimed in U.S. Pat. No. 7,073,565. The casting surface may be coated with chrome, nickel, or other coating material to protect the texture.

Figure 5:
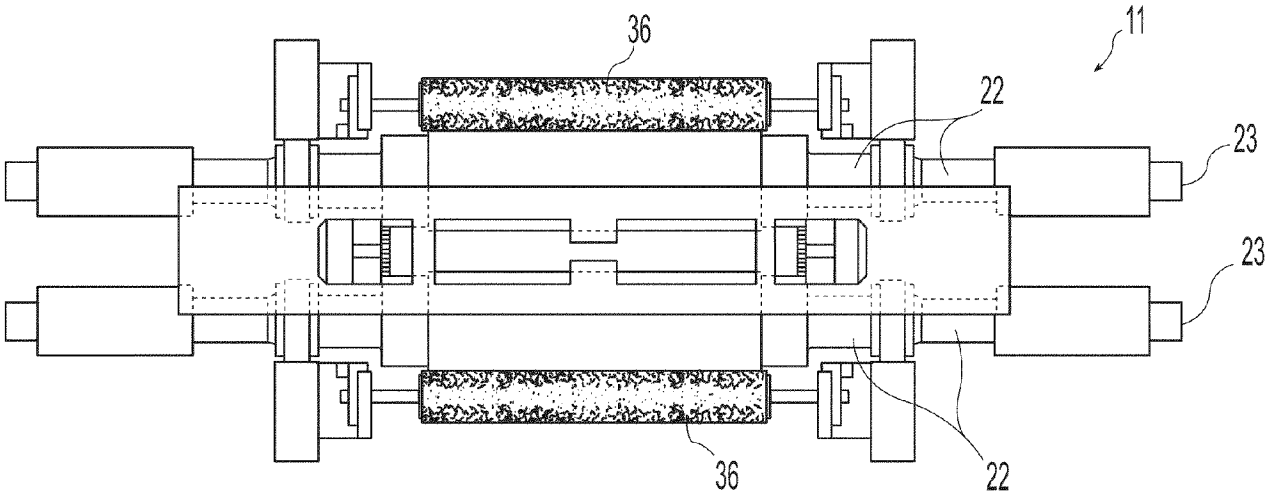
FIG. 5 is a diagrammatical plan view of the roll cassette of FIG. 3 with the rolls removed from the roll cassette.
Figure 6:
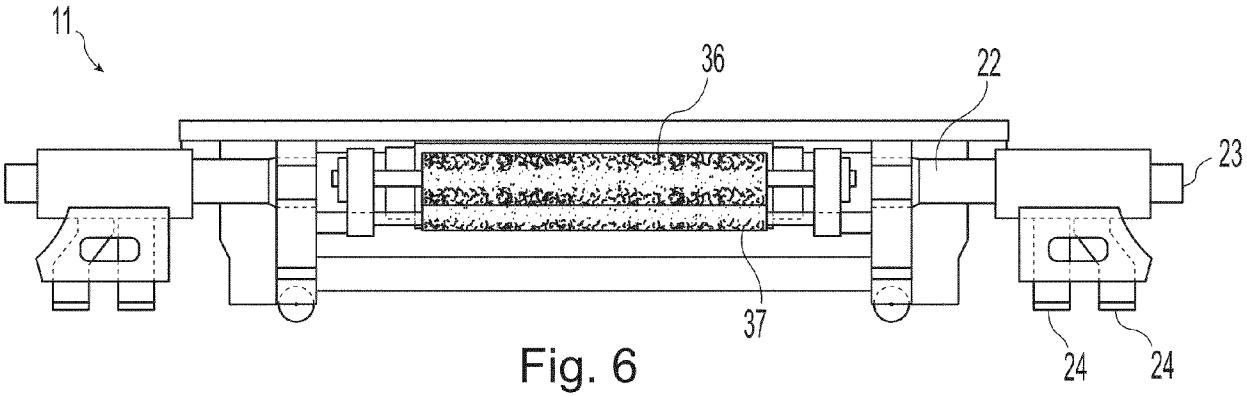
FIG. 6 is a diagrammatical side view of the roll cassette of FIG. 3 with the rolls removed from the roll cassette.
Figure 7:
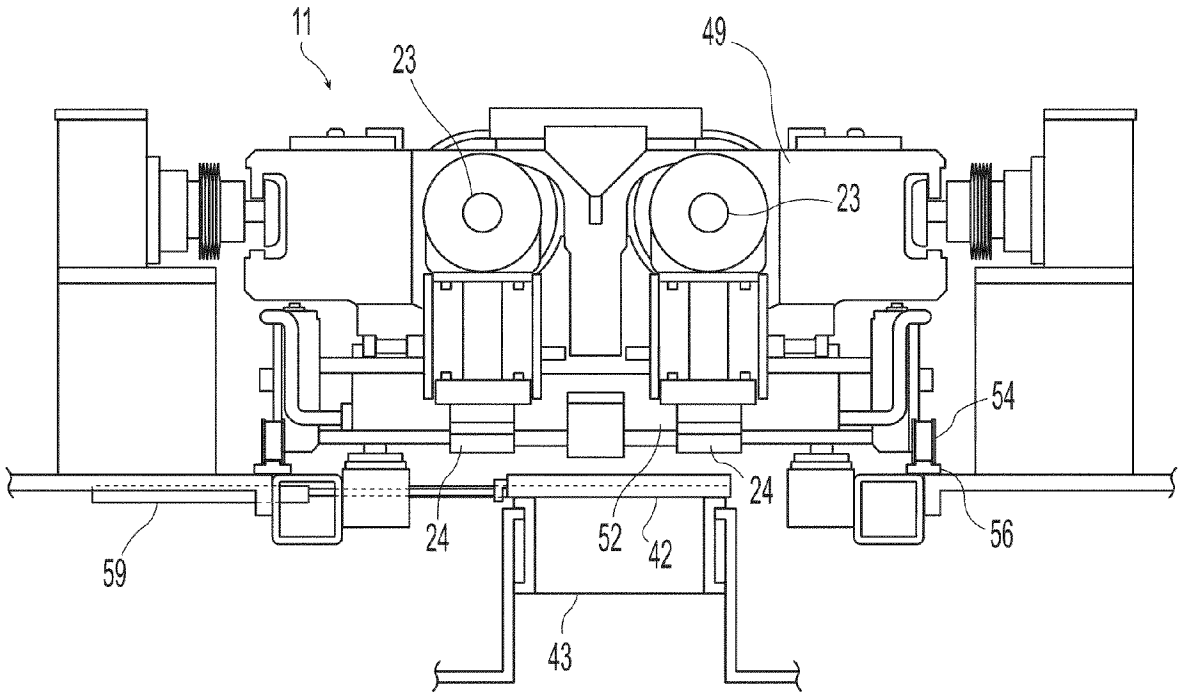
FIG. 7 is a diagrammatical end view of the roll cassette in the casting position.

As shown in FIGS. 3 and 5, cleaning brushes 36 are disposed adjacent the pair of casting rolls, such that the periphery of the cleaning brushes 36 may be brought into contact with the casting surfaces 12A of the casting rolls 12 to clean oxides from the casting surfaces during casting. The cleaning brushes 36 are positioned at opposite sides of the casting area adjacent the casting rolls, between the nip 18 and the casting area where the casting rolls enter the protective atmosphere in contact with the molten metal casting pool 19. Optionally, a separate sweeper brush 37 may be provided for further cleaning the casting surfaces 12A of the casting rolls 12, for example at the beginning and end of a casting campaign as desired.

A knife seal 65 may be provided adjacent each casting roll 12 and adjoining the housing portion 53. The knife seals 65 may be positioned as desired near the casting roll and form a partial closure between the housing portion 53 and the rotating casting rolls 12. The knife seals 65 enable control of the atmosphere around the brushes, and reduce the passage of hot gases from the enclosure 27 around the casting rolls. The position of each knife seal 65 may be adjustable during casting by causing actuators such as hydraulic or pneumatic cylinders to move the knife seal toward or away from the casting rolls.

Once the roll cassette 11 is in the operating position, the casting rolls are secured with the positioning assemblies 50 connected to the roll cassette 11, drive shafts connected to the end couplings 23, and a supply of cooling water coupled to water supply hoses 24. A plurality of jacks 57 may be used to further place the casting rolls in operating position. The jacks 57 may raise, lower, or laterally move the roll cassette 11 in the casting position as desired. The positioning assemblies 50 move one of the casting rolls 12 toward or away from the other casting roll, typically maintained against an adjustable stop, to provide a desired nip, or gap between the rolls in the casting position.

To control the gap between the rolls and control the casting of the strip product, one of the casting rolls 12 is typically mounted in the roll cassette 11 adapted to moving toward and away from the other casting roll 12 during casting. The positioning assemblies 50 include an actuator capable of moving laterally the casting roll toward and away from the other casting roll as desired. Temperature sensors 140 are provided adapted to sensing the temperature of the cast strip downstream from the nip at a reference location and producing a sensor signal corresponding to the temperature of the cast strip below the nip. A control system or controller 142 is provided adapted to control the actuators to vary the gap between the casting rolls to provide a controlled amount of mushy material between the metal shells of the cast strip at the nip in response to the sensor signal received from the sensor and processed to determine the temperature difference between the sensed temperature and a target temperature at a desired location downstream of the nip.

As shown in FIG. 9, the positioning assembly 50 may include an actuator 118 capable of moving a thrust element 120 in connection with the flange 112. Optionally, a force sensor or load cell 108 may be positioned between the thrust element 120 and the flange 112. The load cell 108 is positioned capable of sensing forces urging the casting roll 12 against the thin cast strip casting between the casting rolls 12 indicative of the sensed force exerted on the strip adjacent the nip. Positioning assembly 50 may include an additional load cell capable of measuring the spring compression force.

The thrust element 120 for the positioning assembly 50 may include a spring positioning device 122, a compression spring 124 having a desired spring rate, and a slidable shaft 126 movable against the compression spring 124 within the thrust element 120. A screw jack 128 or other linear actuator may be provided capable of translating the spring positioning device 122, and thereby advancing the slidable shaft 126 and compressing the compression spring 124. The flange 112 is connected to the slidable shaft 126 and displaceable against the compression spring 124.

A location sensor 130 may be provided with positioning assembly 50 to determine the location of the slidable shaft 126, and thereby the position of the flange 112 and the roll chock 49 secured thereto. The position sensor 130 provides signals to the controller 142 indicating the position of the roll chock 49 and associated casting roll 12 to determine the gap between the casting rolls at the nip.

Figure 10:
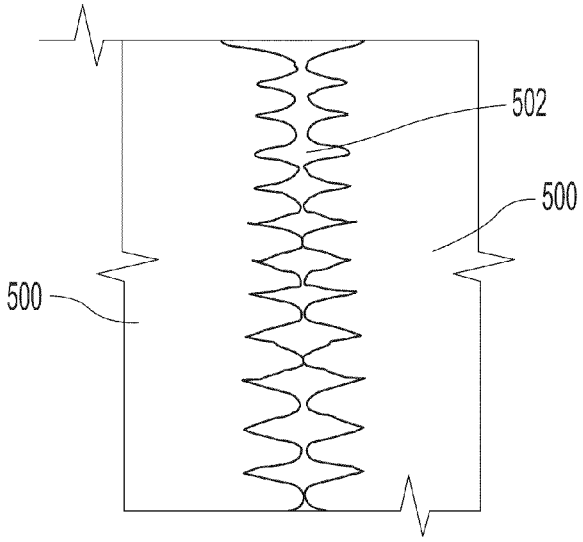
FIG. 10 is a illustrative cross-section of cast strip below the nip.

The casting rolls 12 are internally water cooled so that as the casting rolls 12 are counter-rotated, shells solidify on the casting surfaces 12A as the casting surfaces rotate into contact with and through the casting pool 19. In one alternative, the heat flux density may be between about 7 to 15 megawatts per square meter through the casting roll surfaces. During casting, metal shells formed on the casting surfaces of the casting rolls are brought together at the nip to deliver cast strip downwardly with a controlled amount of mushy material between the metal shells. As illustrated in FIG. 10, mushy material 502 may be swallowed between the metal shells 500. The mushy material 502 between the shells in the strip cast downwardly from the nip may include molten metal and partially solidified metal. The amount of mushy material between the metal shells may be controlled by increasing or decreasing the gap between the casting rolls. Additionally, we have found that the temperature of the cast strip beneath the nip is indicative of the amount of mushy material between the metal shells and can be used as a control of the amount of mushy material provided in the cast strip at the nip.

Presently disclosed is a method of continuously casting metal strip. The method includes assembling a pair of counter-rotatable casting rolls having casting surfaces laterally positioned to form a gap at a nip between casting rolls through which thin cast strip can be cast. The pair of counter-rotatable casting rolls may be assembled as previously described.

The method may include assembling a metal delivery system adapted to deliver molten metal above the nip to form a casting pool supported on the casting surfaces of the casting rolls and confined at the ends of the casting rolls and counter rotating the casting rolls to form metal shells on the casting surfaces of the casting rolls that are brought together at the nip to deliver downwardly as part of the cast strip a controlled amount of mushy material between the metal shells. The controlled amount of mushy material between the metal shells may include molten metal and partially solidified metal, and may include all the material between the shells not sufficiently solidified to be self supportive.

Additionally, the method may include the steps of determining at a reference location downstream from the nip a target temperature of the cast strip corresponding to a desired amount of mushy material between the metal shells of the cast strip at the nip, sensing the temperature of the cast strip downstream from the nip at the reference location and producing a sensor signal corresponding to the sensed temperature, and causing an actuator to vary the gap at the nip between the casting rolls in response to the sensor signal received from the sensor and processed to determine the temperature difference between the sensed temperature and the target temperature.

To control the amount of mushy material between the metal shells, the temperature of the metal shells downstream of the nip may be sensed or measured. Various devices are known for measuring temperature including temperature profile sensors capable of sensing the strip temperature at a plurality of locations along the strip width and producing an electrical signal indicative of the strip temperature. Alternatively or in addition, the temperature sensor 140 may include a scanning pyrometer or an array temperature sensor.

The temperature sensors 140 may be positioned to sense the temperature of the cast strip in a continuum along the strip width by a scanning pyrometer or other temperature sensing devices. Alternatively, the temperature may be sensed in discrete locations along the strip width. The temperature sensors 140 may be positioned to determine the temperatures of the cast strip in segments across the cast strip. Additionally, temperature sensors 140 may be positioned at a single reference location downstream from the nip or may be positioned at several reference locations downstream from the nip to provide a representative temperature of the cast strip. The temperature sensors 140 may be positioned to sense the temperature at one or more reference locations between about 0.2 meters and 2.0 meters from the nip.

A target temperature of the cast strip downstream from the nip at a reference location may be empirically correlated with a desired range of amounts of mushy material between the metal shells of the cast strip. The target temperature may be determined from empirical data, which may be updated as desired. Alternatively or in addition, the target temperature may be calculated based on the heat transfer properties, thickness, chemistry, and other properties of solidifying metal in the cast strip. In any event, the target temperature is determined at a reference location downstream from the nip to correspond to a desired amount of mushy material between the metal shells of the cast strip by available and desired data within desired or available limits of accuracy. Thus, the target temperature may actually be a bracketed range of temperatures corresponding to amounts of mushy material between the metal shells within acceptable tolerances.

Figure 11:
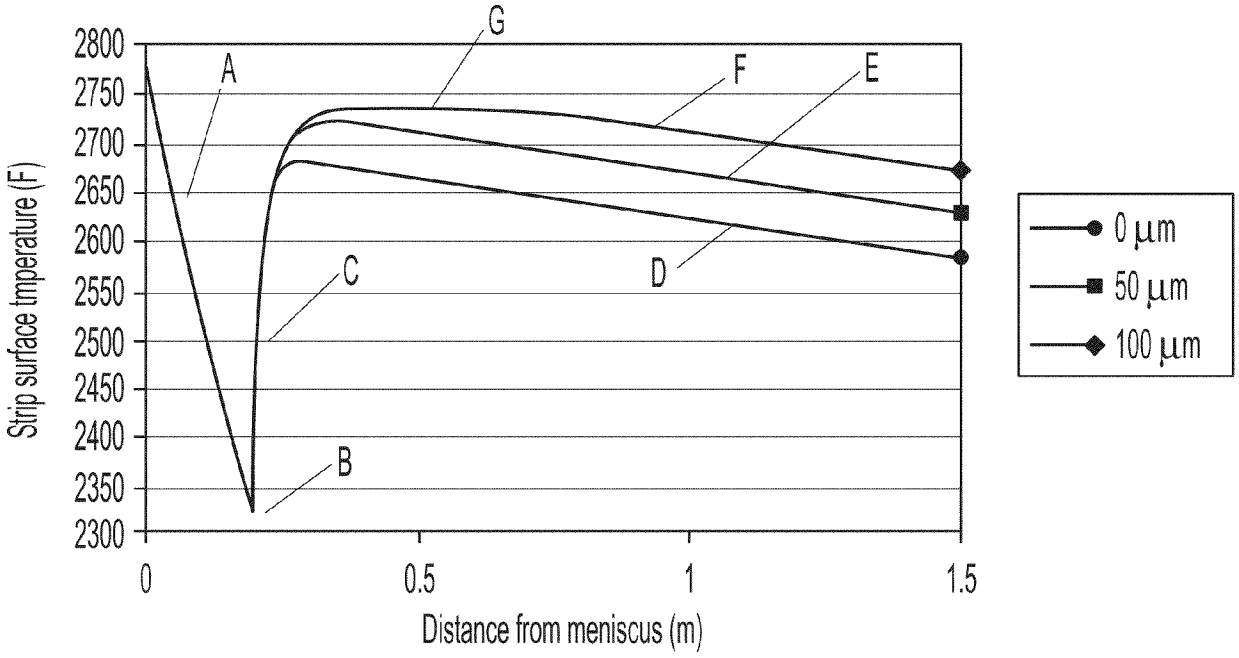
FIG. 11 is a graph of strip temperature.

As shown in FIG. 11, the temperature of the cast strip downstream from the nip may be varied with amounts of mushy material between the metal shells. In FIG. 11, line A identifies the decreasing temperature of the cast strip while the strip is in contact with the casting surface of the cooled casting rolls. Point B corresponds to the nip where the metal shells separate from the casting rolls to form the cast strip cast downward from the nip. Line C corresponds to the temperature rebound, or rebound heating, that occurs downstream from the nip as the mushy material between the metal shells reheats the metal shells as illustrated by rising strip surface temperature. For a certain amount of mushy material between the shells, the excess temperature from temperature rebound before the hot rolling mill may cause austenite grain growth and a coarser microstructure. Referring to point G, the temperature rebound may re-heat the strip to a temperature forming δ-ferrite, which upon cooling returns to a coarser and more variable austenite microstructure, and in any case, may cause ridges in the cast strip. In severe circumstances, the mushy material may reheat the metal shells to the point of re-melting the metal shells resulting in additional undesired surface defects and potentially even breakage of the cast strip. Effects of temperature rebound may be controlled by controlling the amount of mushy material between the shells with lower amounts of mushy material tending to provide less ridges and other surface defects until the amount of mushy material reduces to where high frequency chatter begins to be seen.

As shown in FIG. 11, the temperature rebound occurs for a distance downstream of the nip. The extent of temperature rebound or reheating of the cast strip is controlled by the amount of mushy material relative to the amount of the solidified material in the cast strip upon exiting the nip. As shown by lines D, E, and F, after leaving the nip the temperature of the surface of the cast strip increases as the heat from the mushy material transfers to the shells and then begins to decrease as the strip cools. Lines D, E, and F illustrate three calculated examples of temperature rebound for different amounts of mushy material formed between the metal shells during the cast. Line D illustrates the temperature of the cast strip with zero micrometers of mushy material between the metal shells upon exiting the nip. Line E illustrates the temperature of the cast strip with fifty micrometers of mushy material between the metal shells upon exiting the nip. Line F illustrates the temperature of the cast strip with 100 micrometers of mushy material between the metal shells upon exiting the nip. As shown by lines D, E, and F, a greater amount of mushy material between the metal shells upon exiting the nip corresponds to a higher strip temperature or greater temperature rebound of the cast strip downstream of the nip. Using the relationship between the temperature rebound and the amount of mushy material between the metal shells, calculated and/or determined empirically, a target temperature of the cast strip downstream from the nip at a reference location may be determined that corresponds to a desired amount of mushy material between the metal shells of the cast strip to reduce both ridges in the strip and high frequency chatter.

Figure 12A:
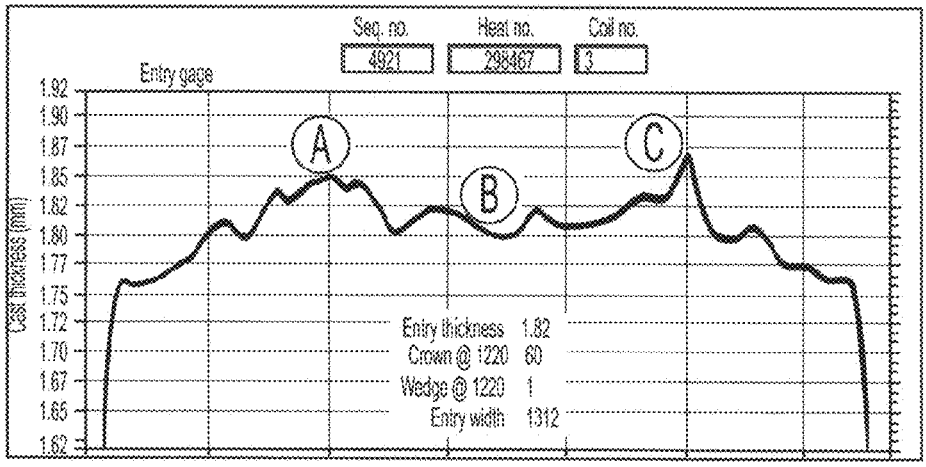
FIG. 12A is a graph of strip thickness profile.
Figure 12B:
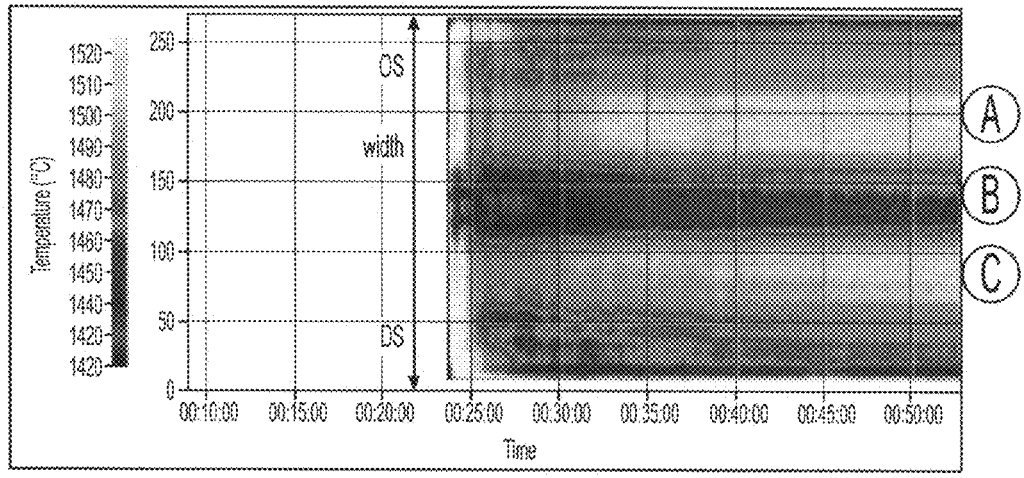
FIG. 12B is a graph of measured strip temperature corresponding to the strip profile of FIG. 12A.

FIG. 12A is a graph showing the thickness profile of a sample of cast strip across the width of the strip. In this example, the thickness of the cast strip varies across the width of the strip. Reference points A and C identify portions of the cast strip that are thicker than the portion identified by reference point B. Referring now to FIG. 12B, the temperature of the cast strip across the width of the strip is shown. In FIG. 12B, the width of the strip is along the y-axis and the temperature of the surface of the cast strip is illustrated over a selected time interval along the x-axis. As illustrated, the temperature of the strip at references points A and C is hotter than the temperature of the cast strip at reference point B. In this example, the thinner portion of the cast strip, reference point B, is approximately 1450° F., whereas the thicker portions of the strip, reference points A and C, are approximately 1500-1520° F. as a result of greater amount of mushy material between the shells.

The reference location where the strip temperature is measured downstream of the nip may be positioned at various locations. The reference location may be a single location or may be multiple locations downstream of the nip. As shown in FIG. 11, the relationship between the temperature of the cast strip and the amount of mushy material between the metal shells may extend for a distance downstream of the nip and the reference location may be selected within this distance. The reference location may be between about 0.2 meters and 2.0 meters from the nip. In one example, the reference location may be 0.5 meters downstream from the nip. In another example the reference location may be 1 meter downstream from the nip. However, as shown in FIG. 11, a reference location too close to the nip will miss the extent of the temperature rebound, and downstream heat losses will diminish the measurable effect of a reference location too far from the nip. Practical limitations may also be considered in locating the reference location due to the high temperature of the cast strip immediately below the nip.

As is apparent to those of skill in the art, the target temperature may be one or more temperatures at one or more reference locations as desired for use in the controller. The target temperature may also be determined from a formula for combining multiple temperature measurements.

The temperature of the cast strip may be sensed and a sensor signal may be produced corresponding to the sensed temperature. The sensor signal may be an electrical sensor signal. Additionally, various signal processing techniques such as averaging, summing, differencing, and filtering may be applied to the sensor signal corresponding to the sensed temperature. Such signal processing techniques may improve the performance or stability of the controller 142 and/or improve the quality of the cast strip. The sensor signal may correspond to a single temperature measurement or multiple temperature measurements. The sensor signal may also correspond to a combination of multiple temperature measurements. In another example, multiple sensor signals may be utilized to correspond to the temperature of the cast strip at multiple locations across the width and/or length of the cast strip.

To control the position of the casting rolls 12 an actuator may vary the gap between the casting rolls in response to the sensor signal received from the sensor, and processed to determine the temperature difference between the sensed temperature and the target temperature. The sensor signal may be processed to determine the temperature difference between the sensed temperature and the target temperature by any appropriate signal processing techniques, including analog or digital processing.

The gap between the casting rolls 12 at the nip may be varied by servomechanism or another drive to control the amount of mushy material between the metal shells. For example, the gap between the casting rolls may be varied by the actuator to control the amount of mushy material between the metal shells of the cast strip to be between about 10 and 200 micrometers, and more particularly between about 10 and 100 micrometers, in response to the sensor signal processed to determine the temperature difference between the sensed temperature and the target temperature. In another example, the gap between the casting rolls may be varied by the actuator to control the amount of mushy material between the metal shells of the cast strip to be between about 20 and 50 micrometers in response to the processed sensor signal.

The method of continuously casting metal strip may also include counter rotating the casting rolls to provide a casting speed between 40 and 100 meters per minute. In one example, the as-cast thickness of the cast strip may be between 0.6 and 2.4 millimeters. Other as-cast thicknesses are also contemplated depending upon the capabilities of the casting system. In any event, the as-cast thickness may be greater than the desired thickness of the final product after hot rolling of the cast strip.

As previously discussed, a casting pool of molten metal is supported on the casting surfaces of the casting rolls 12 above the nip. The casting pool height may be between about 125 and 250 millimeters above the nip where the casting rolls are 500 to 700 millimeters in diameter. In one example, the casting pool height may be between about 160 and 180 millimeters. In another example, the casting pool height may be greater than 250 millimeters above the nip, for example when larger casting rolls are utilized. The casting pool height is measured as the vertical distance between the meniscus of the casting pool and the nip. Additionally, in one example, the heat flux density may be 7 to 15 megawatts per square meter through the casting rolls.

The apparatus for continuously casting metal strip may have a pair of counter-rotatable casting rolls having casting surfaces laterally positioned to form a gap at a nip between the casting rolls through which thin cast strip can be cast, a metal delivery system adapted to deliver molten metal above the nip to form a casting pool supported on the casting surfaces of the casting rolls and confined at the ends of the casting rolls that are brought together at the nip to deliver cast strip downwardly from the nip with a controlled amount of mushy material between the metal shells, a sensor adapted to sensing the temperature of the cast strip cast downstream from the nip at a reference location and producing a sensor signal corresponding to the temperature of the cast strip below the nip, and a controller 142 adapted to control an actuator to vary the gap between the casting rolls to provide a controlled amount of mushy material between the metal shells of the cast strip at the nip in response to the sensor signal received from the sensor and processed to determine the temperature difference between the sensed temperature and a target temperature.

Additionally, the method of continuously casting metal strip may include controlling the crown of the cast strip by controlling the amount of mushy material between the metal shells. The casting rolls 12 may have a profile that produces a crown on the cast strip, for example between about 10 and about 100 micrometers crown at the center of the strip. Additionally, the reheating of the metal shells combined with the ferrostatic pressure of the mushy material exerted outward on the shells may cause the thickness of the cast strip to increase. The increase in the thickness of the cast strip may be controlled with the amount of mushy material between the metal shells. The thickness of the metal shells is substantially the same across the width of the casting rolls 12. The profile of the casting rolls that produce a crown on the cast strip combined with the substantially like thickness of the metal shells across the width of the casting rolls results in a greater amount of mushy material being swallowed by the cast strip near the center of the casting rolls as compared to the ends of the casting rolls. When mushy material is swallowed between the metal shells, the mushy material reheats the metal shells downstream from the nip as previously discussed. As such, the increase in the thickness of the cast strip due to reheating of the metal shells and the ferrostatic pressure of the mushy material may be greater towards the center of the cast strip as compared to the ends of the cast strip causing a bulge that increases the effective crown across the profile of the cast strip. In one embodiment, the gap between the casting rolls may be controlled to provide a controlled amount of mushy material between the metal shells to provide a desired crown of the cast strip. For a given casting roll crown, the presently disclosed method may enable the production of cast strip with a range of crown profiles greater than the crown of the casting rolls. Controlling the increase in the crown profile of the cast strip may be desired to facilitate subsequent rolling operations. By controlling the amount of mushy material between the shells a variety of cast strip crowns may be produced without the need to change the casting rolls as was previously required.

The crown of the cast strip may be controlled to specific customer requirements. The presently disclosed method may include receiving a customer-specified strip crown, and determining the target temperature to produce the customer-specified strip crown. Then, sensing the temperature of the cast strip cast downstream from the nip during casting at the reference location and producing a sensor signal corresponding to the sensed temperature, and causing an actuator to vary the gap at the nip between the casting rolls in response to the sensor signal received from the sensor and processed to determine the temperature difference between the sensed temperature and the target temperature to produce the desired strip crown.

In yet another example, the method of continuously casting metal strip may also include sensing the location or position of the casting rolls, sensing the force exerted on the strip adjacent the nip, and/or sensing the thickness profile of the cast strip downstream of the nip. Sensor signals may be produced corresponding to the location, force, or profile measurements. In addition to the sensor signal corresponding to the sensed temperature of the cast strip to provide a controlled amount of mushy material between the metal shells, sensor signals corresponding to the location, force, and/or thickness profile measurements may be used for controlling the location of the rolls, the forces on the rolls, and the downstream thickness profile of the strip.

For example, the location sensors 130 may be provided and positioned capable of sensing the location of the casting rolls 12, and producing electrical signals indicative of each casting roll position to determine the gap between the casting rolls. The controller 142 may be capable of receiving the electrical signals indicative of the position each casting roll, and causing the actuators to vary the gap at the nip between the casting rolls in response to the sensor signal received from the location sensor and the sensor signal received from the strip temperature sensor 140 processed to determine the temperature difference between the sensed temperature and the target temperature. The location sensors 130 may be linear displacement sensors, such as for example but not limited to voltage differential transducers, variable inductance transducers, variable capacitance transducers, eddy current transducers, magnetic displacement sensors, optical displacement sensors, or other displacement sensors.

The controller 142 may include one or more controllers, such as programmable computers, programmable microcontrollers, microprocessors, programmable logic controllers, signal processors, or other programmable controllers, which are capable of receiving the temperature and roll location sensor signals, processing the sensor signals to determine the temperature difference between the sensed temperature and the target temperature, and providing control signals capable of causing the actuators to move as desired.

Additionally, the controller 142 may control the casting of the strip product responsive to forces exerted on the strip adjacent the nip. The force sensors or load cells 108 are capable of sensing the forces exerted on the strip adjacent the nip and producing electrical signals indicative of the sensed forces on the strip. Then, the controller 142 may be capable of receiving the electrical signals indicative of the sensed forces exerted on the strip and causing the actuators to move the casting rolls responsive to the sensed forces exerted on the strip. The controller 142 may be capable of causing an actuator to move at each end of each casting roll responsive to the sensed forces exerted on the strip. The controller may utilize the temperature, location, and force sensor data to control the casting of the strip product to achieve the desired properties. As described in U.S. Pat. No. 7,464,764, the gauge variations in cast strip can be controlled by having a roll separation force that is higher than that required to balance the ferrostatic pool pressure and to overcome the mechanical friction involved in moving the rolls. In particular, a roll separation force in the range of between 2 and 4.5 Newtons per millimeter has been effective in controlling the quality of the strip.

In yet another embodiment, thickness profile sensors may be positioned downstream of the nip capable of sensing the strip thickness profile at a plurality of locations along the strip width, and producing electrical signals indicative of the strip thickness profile downstream of the nip. In one example, the profile sensors may be positioned adjacent the sensor adapted to sensing the temperature of the cast strip downstream from the nip. Then, the controller 142 may be capable of processing the electrical signals indicative of the strip thickness profile in addition to the sensor signal corresponding to the temperature of the cast strip below the nip, and causing the actuators to move the casting rolls and further control the thickness profile of the cast strip responsive to the electrical signals indicative of the strip thickness profile.

As is apparent, the presently disclosed method and apparatus utilizing temperature sensors 140 may be used with or without the location sensors, force sensors, and profile sensors discussed above.

While the invention has been described with reference to certain embodiments it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments falling within the scope of the appended claims.

What is claimed is:

1. A method of continuously casting metal strip comprising:

assembling a pair of counter-rotatable casting rolls having casting surfaces laterally positioned to form a gap at a nip between the casting rolls through which thin cast strip can be cast, assembling a metal delivery system adapted to deliver molten metal above the nip to form a casting pool supported on the casting surfaces of the casting rolls and confined at the ends of the casting rolls and counter rotating the casting rolls to form metal shells on the casting surfaces of the casting rolls that are brought together at the nip to deliver cast strip downwardly with a controlled amount of mushy material between the metal shells, determining at a reference location downstream from the nip a target temperature for the cast strip corresponding to a desired amount of mushy material between the metal shells of the cast strip, sensing the temperature of the cast strip cast downstream from the nip at the reference location and producing a sensor signal corresponding to the sensed temperature, and causing an actuator to vary the gap at the nip between the casting rolls in response to the sensor signal received from the sensor and processed to determine the temperature difference between the sensed temperature and the target temperature.

2. The method of continuously casting metal strip as claimed in claim 1 where the gap between the casting rolls is varied by the actuator to control the amount of mushy material between the metal shells of the strip cast to be between about 10 and 200 micrometers in response to the processed sensor signal.

3. The method of continuously casting metal strip as claimed in claim 1 where the gap between the casting rolls is varied by the actuator to control the amount of mushy material between the metal shells of the strip cast to be between about 10 and 100 micrometers in response to the processed sensor signal.

4. The method of continuously casting metal strip as claimed in claim 1 where the gap between the casting rolls is varied by the actuator to control the amount of mushy material between the metal shells of the strip cast to be between about 20 and 50 micrometers in response to the processed sensor signal.

5. The method of continuously casting metal strip as claimed in claim 1 where the casting rolls are counter-rotated to provide a casting speed between about 40 and 100 meters per minute.

6. The method of continuously casting metal strip as claimed in claim 1 where the as-cast thickness of the cast strip is between about 0.6 and 2.4 millimeters.

7. The method of continuously casting metal strip as claimed in claim 1 where the casting pool height is between about 125 and 250 millimeters above the nip.

8. The method of continuously casting metal strip as claimed in claim 1 where the heat flux density is between about 7 and 15 megawatts per square meter.

9. An apparatus for continuously casting metal strip comprising:

a pair of counter-rotatable casting rolls having casting surfaces laterally positioned to form a gap at a nip between the casting rolls through which thin cast strip can be cast, a metal delivery system adapted to deliver molten metal above the nip to form a casting pool supported on the casting surfaces of the casting rolls and confined at the ends of the casting rolls that are brought together at the nip to deliver cast strip having metal shells downwardly from the nip with a controlled amount of mushy material between the metal shells, a sensor adapted to sense the temperature of the cast strip downstream from the nip at a reference location and producing a sensor signal corresponding to the temperature of the cast strip below the nip, and a controller adapted to control an actuator to vary the gap between the casting rolls to provide a controlled amount of mushy material between the metal shells of the cast strip at the nip in response to the sensor signal received from the sensor and processed to determine the temperature difference between the sensed temperature and a target temperature.

10. The apparatus for continuously casting metal strip as claimed in claim 9 where the amount of mushy material between the metal shells of the strip cast is between about 10 and 200 micrometers.

11. The apparatus for continuously casting metal strip as claimed in claim 9 where the amount of mushy material between the metal shells of the strip cast is between about 10 and 100 micrometers.

12. The apparatus for continuously casting metal strip as claimed in claim 9 where the amount of mushy material between the metal shells of the strip cast is between about 20 and 50 micrometers.

13. The apparatus for continuously casting metal strip as claimed in claim 9 where the casting rolls have a casting speed between about 40 and 100 meters per minute.

14. The apparatus for continuously casting metal strip as claimed in claim 9 where the as-cast thickness of the cast strip is between about 0.6 and 2.4 millimeters.

15. The apparatus for continuously casting metal strip as claimed in claim 9 where the casting pool height is between about 125 and 250 millimeters above the nip.

16. The apparatus for continuously casting metal strip as claimed in claim 9 where the heat flux density is between about 7 and 15 megawatts per square meter.

17. The apparatus for continuously casting metal strip as claimed in claim 9 further comprising a sensor adapted to sense the location of the casting rolls and producing a sensor signal corresponding to the position of the casting rolls.

18. The apparatus for continuously casting metal strip as claimed in claim 9 further comprising a sensor adapted to sense a force exerted on the cast strip adjacent the nip and producing a sensor signal corresponding to the force exerted on the cast strip adjacent the nip.

19. A method of continuously casting metal strip comprising:

assembling a pair of counter-rotatable casting rolls having casting surfaces laterally positioned to form a gap at a nip between the casting rolls through which thin cast strip can be cast, assembling a metal delivery system adapted to deliver molten metal above the nip to form a casting pool supported on the casting surfaces of the casting rolls and confined at the ends of the casting rolls and counter rotating the casting rolls to form metal shells on the casting surfaces of the casting rolls that are brought together at the nip to deliver cast strip downwardly with a controlled amount of mushy material between the metal shells, determining at a reference location downstream from the nip a target temperature for the cast strip corresponding to a desired amount of mushy material between the metal shells of the cast strip to produce a desired strip crown, sensing the temperature of the cast strip cast downstream from the nip at the reference location and producing a sensor signal corresponding to the sensed temperature, and causing an actuator to vary the gap at the nip between the casting rolls in response to the sensor signal received from the sensor and processed to determine the temperature difference between the sensed temperature and the target temperature to produce the desired strip crown.

20. The method of continuously casting metal strip as claimed in claim 19 where the step of determining a target temperature comprises:

receiving a customer-specified strip crown, and determining the target temperature to produce the customer-specified strip crown.

21. The method of continuously casting metal strip as claimed in claim 19 where the gap between the casting rolls is varied by the actuator to control the amount of mushy material between the metal shells of the strip cast to be between about 10 and 200 micrometers in response to the processed sensor signal.

22. The method of continuously casting metal strip as claimed in claim 19 where the gap between the casting rolls is varied by the actuator to control the amount of mushy material between the metal shells of the strip cast to be between about 10 and 100 micrometers in response to the processed sensor signal.

23. The method of continuously casting metal strip as claimed in claim 19 where the gap between the casting rolls is varied by the actuator to control the amount of mushy material between the metal shells of the strip cast to be between about 20 and 50 micrometers in response to the processed sensor signal.

24. The method of continuously casting metal strip as claimed in claim 19 where the casting rolls are counter-rotated to provide a casting speed between about 40 and 100 meters per minute.

25. The method of continuously casting metal strip as claimed in claim 19 where the as-cast thickness of the cast strip is between about 0.6 and 2.4 millimeters.

26. The method of continuously casting metal strip as claimed in claim 19 where the casting pool height is between about 125 and 250 millimeters above the nip.

27. The method of continuously casting metal strip as claimed in claim 19 where the heat flux density is between about 7 and 15 megawatts per square meter.

* * * * *